United States Patent [19]

Boice

[11] 4,060,286

[45] Nov. 29, 1977

[54] WEAR RESISTANT DRILL PIPE COLLAR AND METHOD OF MAKING SAME

[75] Inventor: Elvin G. Boice, Richmond, Va.

[73] Assignee: Reynolds Metals Company, Richmond, Va.

[21] Appl. No.: 728,739

[22] Filed: Oct. 1, 1976

[51] Int. Cl.[2] ..... F16C 29/00

[52] U.S. Cl. ..... 308/4 A; 29/149.5 R; 29/433; 175/325; 308/239

[58] Field of Search ..... 308/4 R, 4 A, 6 R, 6 A, 308/239; 29/149.5 R, 149.5 C, 433; 175/73, 76, 323, 325, 408; 285/333; 166/241

[56] References Cited

U.S. PATENT DOCUMENTS

| | | | |
|---|---|---|---|
| 1,814,183 | 7/1931 | Patterson | 308/4 A |
| 2,099,661 | 11/1937 | Sharp | 308/239 |
| 2,197,778 | 4/1940 | Cowan | 308/4 A |
| 2,288,124 | 6/1942 | Creighton | 308/4 A |
| 2,696,413 | 12/1954 | Wheildon | 308/4 A |
| 3,074,767 | 1/1963 | Rosenberg | 308/4 A |
| 3,480,094 | 11/1969 | Morris | 308/4 A |
| 3,697,141 | 10/1972 | Garrett | 308/4 A |
| 3,784,238 | 1/1974 | Chance et al. | 308/4 A |
| 3,993,368 | 11/1926 | Jurgens et al. | 308/4 A |

FOREIGN PATENT DOCUMENTS

| | | | |
|---|---|---|---|
| 1,303,307 | 7/1962 | France | 29/433 |

*Primary Examiner*—Trygve M. Blix
*Assistant Examiner*—Edward R. Kazenske
*Attorney, Agent, or Firm*—Glenn, Lyne, Gibbs & Clark

[57] ABSTRACT

A wear-resistant drill pipe collar and method of making same are provided wherein such collar has at least one annular groove defined therein and such groove has cooperating surfaces which hold a plurality of easily installed and removed wear-resistant inserts which protect the collar and its associated pipe structure against excessive wear during rotation and axial movement thereof in an abrasive environment.

27 Claims, 9 Drawing Figures

WEAR RESISTANT DRILL PIPE COLLAR AND METHOD OF MAKING SAME

BACKGROUND OF THE INVENTION

In a typical earth boring operation, an elongated shaft or so-called drill string often assembled from lengths of tubular drill pipes is subjected to an abrasive environment presented by the surface of the walls of an open earth bore; and, such an abrasive environment results in substantial wear (particularly during rotation of the pipes) causing wear and thinning of portions of certain pipes resulting in parting of the drill string and dropping of such drill string within the bored hole.

It is known in the art to provide components on drill pipes which are provided with wear-resistant materials to prevent premature wear thereof; however, the previously proposed components are generally deficient in that such components are either very expensive to produce or it is difficult to install the wear-resistant material thereon. In addition, the installation process associated with such previously proposed components often impairs the integrity of the drill pipe or the components are not capable of refurbishment in the field except by highly paid craftsman skilled in the particular art or process.

SUMMARY

Accordingly, it is a feature of this invention to provide an improved wear-resistant rotatable drill pipe component and method of making same which overcome the abovementioned deficiencies.

Another feature of this invention is the provision of a drill pipe component of the character mentioned which has at least one annular groove defined therein and such groove has cooperating surfaces which hold a plurality of easily installed and removed inserts which protect such component and drill string structure associated therewith against excessive wear during operation and movement thereof in an abrasive environment.

Another feature of this invention is the provision of a wear-resistant drill pipe collar of the character mentioned comprising a main body having at least one substantially annular groove and an access opening for the groove defined therein with the groove extending around the main body from opposite locations of the access opening. The groove is defined by a bottom surface having opposed end edges defining a particular width for the bottom surface and a pair of opposed side surfaces adjoining the end edges with the side surfaces having outer edges spaced apart a distance less than the width to thereby define the groove having a constricted substantially annular opening. A plurality of inserts made of a wear-resistant material are disposed within the groove and each of the inserts is confined by the bottom surface and the side surfaces and has an outer portion extending between the constricted opening with each outer portion having a wear-resistant exposed surface which conforms to the configuration of the outside surface of the main body. Each of the inserts is adapted to be inserted in and removed from the groove through the access opening and a plug is fixed to the main body within the access opening to prevent movement of the inserts within the annular groove and egress of the inserts from the access opening.

Accordingly, it is an object of this invention to provide an improved wear-resistant drill pipe component and method of making same having one or more of the novel features set forth above or hereinafter shown or described.

Other details, features, objects, uses, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
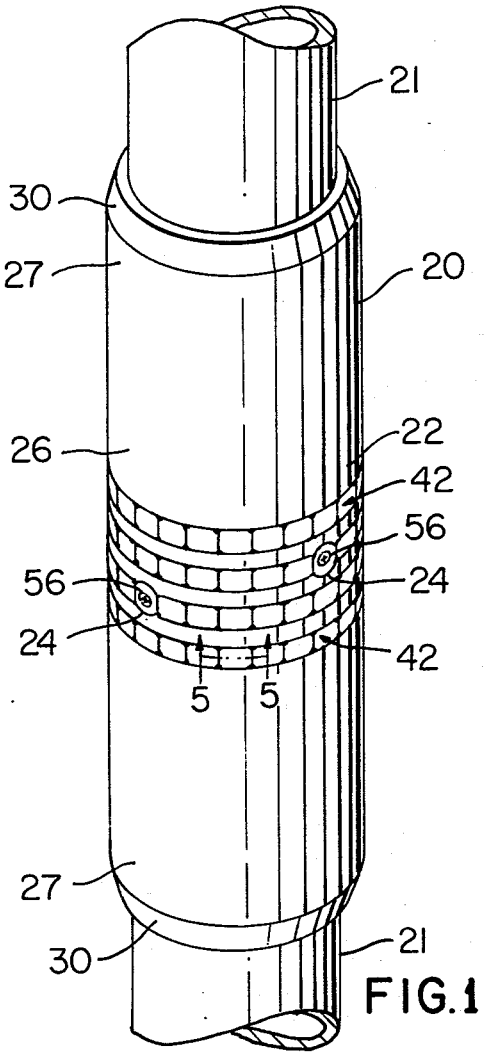
FIG. 1 is a view in elevation of one exemplary embodiment of a drill pipe component of this invention and method of making same in the form of a coupling collar used to detachably couple or fasten together a pair of drill pipes and wherein only fragmentary portions of such drill pipes are shown.
Figure 3:
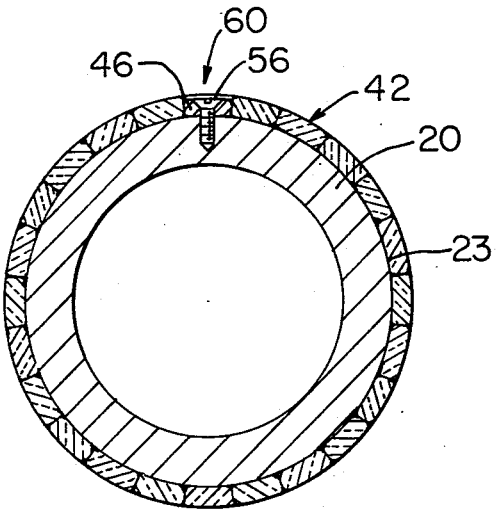
FIG. 3 is a cross-sectional view taken essentially on the line 3—3 of FIG. 2.
Figure 2:
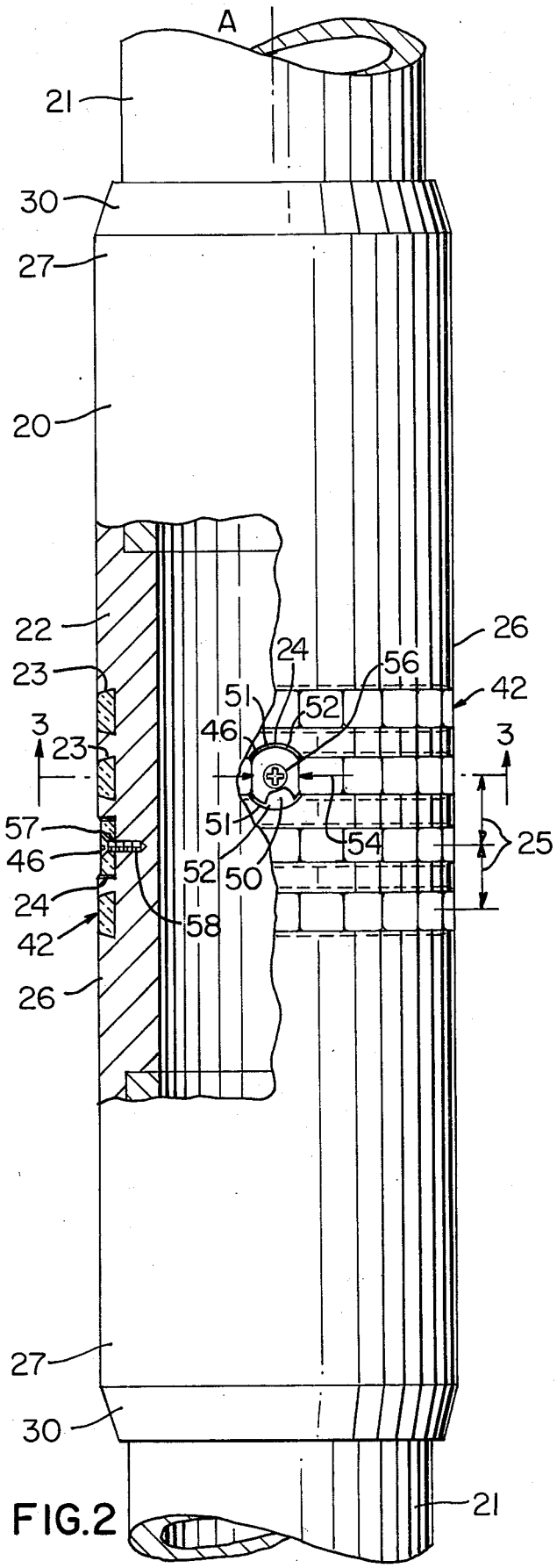
FIG. 2 is a view similar to FIG. 1 drawn to an enlarged scale with the central portion of the collar broken away to illustrate the manner in which wear-resistant inserts and a pair of typical plugs for the wear-resistant inserts are installed in the main body.

Reference is now made to FIGS. 1–3 of the drawings which illustrate one exemplary embodiment of a wear-resistant drill pipe member or component and method of making same in the form of a collar 20; and the collar 20 is shown as a coupling collar which couples two drill pipe sections or drill pipes each designated by the same reference numeral 21. The collar 20 has suitable means (not shown) of known construction detachably fastened between the member 20 and each drill pipe section 21 for holding the two pipe sections 21 together in the usual manner.

The collar 20 has a main body 22 which has a plurality of annular grooves 23 and a plurality of access openings 24 for the grooves 23 defined therein with each access opening 24 being associated with one groove 23. The exemplary collar 20 has a plurality of four substantially identical grooves 23 and four substantially identical access openings 24 associated therewith; and, the grooves 23 are axially spaced apart the same distance as indicated by typical reference numerals 25 between the center lines of three grooves 23 in FIG. 2. The grooves 23 are provided in the central portion of the main body 22 and the access openings 24 are equally angularly spaced apart for reasons to be explained in detail subsequently whereby the plurality of four access openings 24 are angularly spaced apart 90° about a substantially right circular cylindrical outside surface 26 of the main body 22. The main body 22 of the member 20 has symmetrically arranged opposed ends 27 each of which gradually tapers toward an associated pipe 21 and each end 27 has a substantially frustoconical surface 30 adjoining an associated end edge of the surface 26.

As previously mentioned, the four annular grooves 23 and the four access openings 24 are identical whereby the detailed description will now proceed with the detail description of one annular groove 23 and an access opening 24 associated therewith and it is to be understood that such detailed description is fully applicable to all the grooves 23 and openings 24.

Figure 6:
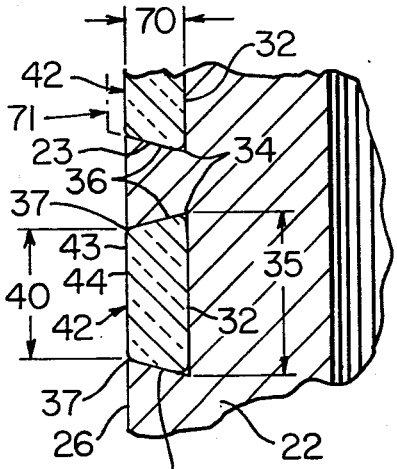
FIG. 6 is a fragmentary cross-sectional view taken essentially on the line 6—6 of FIG. 5.

As best seen in FIG. 6, each groove 23 is defined by a bottom surface 32 having opposed end edges 34 defining a particular axial height or width 35 for such bottom surface 32; and, each groove is also defined by a pair of opposed side surfaces each designated by the same reference numeral 36 adjoining the end edges 34. The side surfaces have outer edges 37 spaced apart a distance 40 which is less than the width 35 of the bottom surface 32 to thereby define each groove 23 having a constricted annular opening with such constricted annular opening extending between the edges 37.

The collar 20 also has a plurality of inserts each designated by the same reference numeral 42 with only a few representative ones of such inserts being thus designated; and, the inserts 42 are disposed within each annular groove 23. The inserts are made of a wear-resistant material which has a wear resistance greater than the wear resistance of the main body 22. Each insert 42 is confined by the bottom surface 32 and side surfaces 36 of its annular groove 23 and each insert 42 has an outer portion 43 extending between the constricted opening 40 and the outer portion 43 has a wear-resistant exposed surface 44 which conforms substantially to the configuration of the right circular cylindrical outside surface 26. Each of the inserts 42 is adapted to be inserted into its groove 23 through an associated access opening 24 and a plug 46 is provided and disposed within each access opening 24 and suitably fixed to the main body 22 to prevent movement of the plug 46 and egress of the inserts 42 from within its groove 23 and access opening 24.

Figure 7:
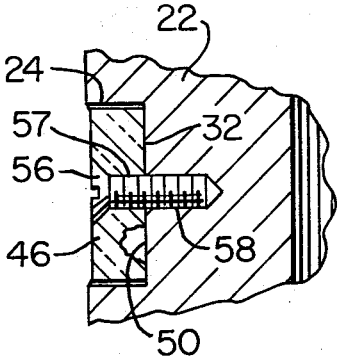
FIG. 7 is an enlarged cross-sectional view of a typical groove inlet opening and a plug detachably installed therewithin with a portion of the plug broken away.

Each access opening 24 has a lowermost surface portion 50, see FIG. 7, which blends smoothly with the bottom surface 32 to provide a substantially right circular cylindrical bottom surface and thus a smooth continuous bottom for each groove 23 and its opening 24. The surface portion 50 also serves as a support for its plug 46. The main body 22 also has (see FIG. 2) oppositely arranged approximately semi-cylindrical surfaces each designated by the same reference numeral 51 which define enlarged areas 52 at opposed sides of its access opening 24.

To assure easy installation of inserts 42 each access opening 24 has an axial length, i.e., width, and circumferencial dimension 54 which is at least equal to the width 35 of the bottom surface 32. Thus, each insert 42 is initially disposed within an associated access opening 24 and then slid around its associated annular groove 23 while being retained by its side surfaces 36 and bottom surface 32. Once a particular annular groove 23 is filled with wear-resistant inserts 42 an associated plug 46 is suitably detachably fixed in position. In this example the plug 46 is detachably fixed in position by a flat head threaded metal screw 56 which extends through an associated opening 57 in the plug 46 and is threaded within a threaded opening 58 in the main body 22.

The plug 46 is dimensioned so that its top surface and the top surface of the head of screw 56 are recessed beneath the contour of the right circular cylindrical outside surface 26 as indicated at 60 in FIG. 3. This recessed arrangement assures that the plug 46 and fastener 56 will not be subjected to wear.

As mentioned earlier, the four access openings 24 of the grooves 23 are angularly spaced apart 90° and two of such openings 24 are shown in FIGS. 1 and 2. With this arrangement, there is minimum wear of the main body 22 at locations closely adjacent the access openings 24.

The main body 22 and indeed the entire collar 20 of this example is made of a particular material preferably in the form of a particular suitable metal. The inserts 42 are made of a material which has a greater wear-resistance than the wear-resistance of the metal used to make the main body 22; and, each insert 42 may be made of a suitable wear-resistant material such as a ceramic material, alumina, tungsten carbide, or the like. For example, the inserts 42 may be made of between 90 and 99.5% aluminum oxide.

Figure 4:
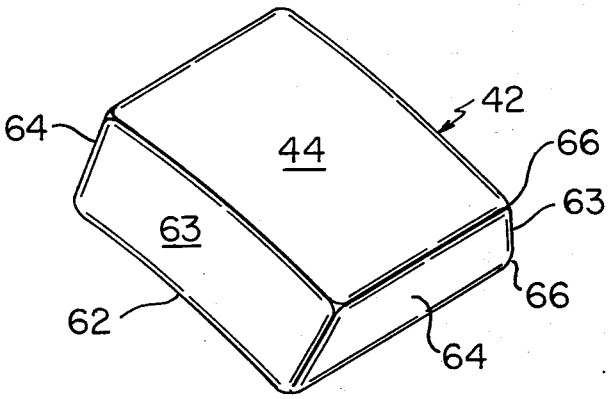
FIG. 4 is a perspective view illustrating a typical wear-resistant insert utilized in the collar of FIG. 1.
Figure 5:
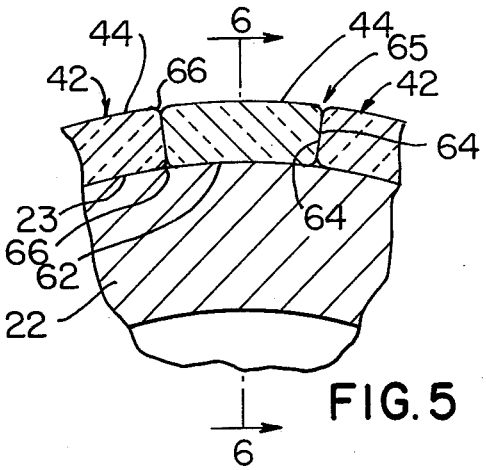
FIG. 5 is an enlarged fragmentary cross-sectional view taken essentially on the line 5—5 of FIG. 1.

As best seen in FIGS. 4 and 5 of the drawings each of the wear-resistant inserts 42 has an inside surface 62 which conforms to the substantially right circular cylindrical bottom surface 32 and the wear-resistant exposed surface 44 of each insert conforms to the right circular cylindrical outside surface 26. In addition, each insert 42 has a substantially trapezoidal cross-sectional configuration when viewed by a diametral plane through the longitudinal axis A of the collar 20 whereby each insert 42 has opposed inclined substantially planar side surfaces each designated by the same reference numeral 63 extending between the surfaces 44 and 62 and opposed surfaces 64. The end surfaces 64 are arranged so as to provide maximum contact area between adjoining inserts 42 and as illustrated at 65 in FIG. 5, for example.

The bottom surface 62 and top surface 44 of each insert 42 comprise portions of imaginary coaxial right circular cylindrical members. Similarly, the opposed surfaces 63 of each insert 42 comprise portions of a pair of planes which intersect on a line disposed at one side of its insert 42 while the opposed surfaces 64 of each insert comprise portions of a pair of planes which intersect on a line disposed at the opposite side of insert 42 with the two lines of the intersecting planes being disposed perpendicular to each other.

Each insert 42 has rounded or beveled edges 66 enabling the insert to be made with minimum stress points or locations while assuring that in utilizing the inserts 42 in an associated member 20 there is minimum likelihood of sharp edges engaging an object and causing damage. For example, the rounded edges 66 may be made during the process of forming ceramic inserts 42 by tumbling the inserts in a suitable abrasive slurry or medium or providing such edges 66 through the use of suitable molds, or the like.

Figure 8:
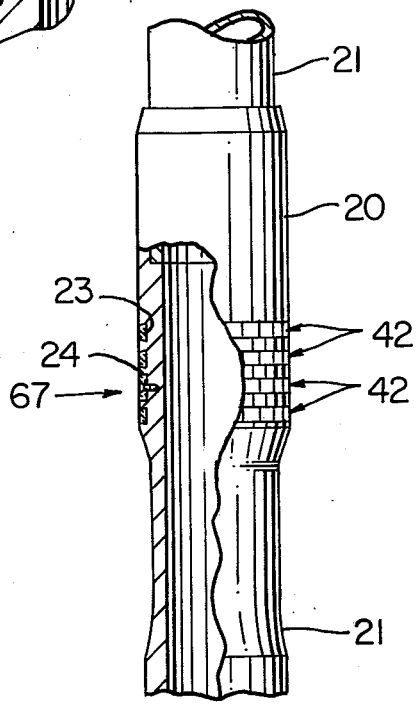
FIG. 8 is a view similar to FIG. 1 illustrating another exemplary embodiment of a drill pipe component of this invention.

Another exemplary embodiment of a collar member 20 of this invention is illustrated in FIG. 8 of the drawings. The only difference between the collar member 20 of FIG. 8 and the collar member 20 illustrated in FIGS. 1–7 is that the collar member of FIG. 8 is integrally formed in and as a single-piece construction of one of the pipes 21 and at one end thereof as shown at 67. The other pipe 21 is detachably fixed to the integral collar 20 utilizing any suitable means (not shown) known in the art. The integral collar 20 of FIG. 8 also has a plurality of wear-resistant inserts 42 suitably disposed in its grooves 23 and each of such inserts is made of a suitable wear-resistant material such as a ceramic material and suitably installed in position through an associated access opening 24 in a similar manner as previously described in connection with the collar 20 of FIG. 1.

Figure 9:
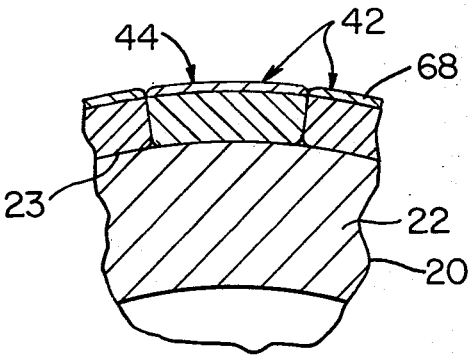
FIG. 9 is a view similar to FIG. 5 illustrating another embodiment of a wear-resistant insert which may be utilized in lieu of the inserts shown in FIGS. 1–8.

The wear-resistant inserts 42 need not necessarily be made of ceramic material but may be made of any suitable wear-resistant material or a combination of materials and as illustrated in FIG. 9 where a plurality of wear-resistant inserts also designated by the reference numeral 42 are shown installed within an associated groove 23 comprising the main body 22 of a member 20. Each insert 42 of FIG. 9 is made of steel and has a wear-resistant surface 44 provided on an outer portion 68 thereof with such outer portion being made of tungsten carbide, or the like. The outer portion 68 is bonded to the main body of its insert 44 to define a singlepiece structure and using any technique known in the art, such as welding, for example, and prior to installation of the insert into an associated annular groove 23. The member 20 of FIG. 9 with its metal inserts 42 may be a collar member having coupling means on opposite end portions or may be provided as an integral part of an associated pipe 21 as shown in FIG. 8.

Each insert 42 may be readily installed in and removed from its groove 23 through an associated access opening 24. It will also be appreciated that should one or more inserts 42 become broken or damaged each may be easily replaced. Similarly, as the inserts 42 and adjoining portions of the collar 20 become worn, such inserts 42 may be readily removed and new inserts installed in position.

The inserts 42 may be constructed so that the height of each, indicated at 70 in FIG. 6, is the same as the radial height of its associated groove 23 whereby the outside surface 44 of each insert is substantially flush with the right circular cylindrical outside surface 26 of the main body 22 of the collar 20. However, it is to be understood that each insert may be provided with a height which is greater than the height indicated at 70 and as indicated at 71 by dot-dash lines whereby the inserts 42 may be constructed of substantial height to provide additional wear and once they wear such that they are substantially flush with the outside right circular cylindrical surface 26 they may be readily replaced.

Each plug 46 is shown fastened in position by a threaded screw 56. However, it is to be understood that any suitable means may be used to detachably fasten the plug in position and may include a snap ring, spot welding, peening a portion of the metal adjoining the plug around such plug, or the like.

It will also be appreciated that the inserts 42 disposed within a particular groove 23 may be disposed loosely therewithin or may be fixed together and/or to their collar utilizing suitable adhesive means, or the like.

Each groove 23 and associated access opening 24 may be defined or formed in its component or collar 20 using any technique known in the art. Preferably the collar 20 is a unitary single-piece metal structure with the metal having a homogeneous character throughout; and, each groove 23 and opening 24 is formed by machining action.

The inserts 42 in the four grooves 23 are shown as being of the same size and circumferential lengths; however, such inserts in each groove 23 and in adjoining grooves need not necessarily be of the same circumferential length provided that when such inserts are made having different circumferential lengths they are made such that they have a maximum area of contact therebetween and as illustrated at 65 in FIG. 5 for the substantially identical size inserts 42.

While present exemplary embodiments of this invention, and methods of practicing the same, have been illustrated and described, it will be recognized that this invention may be otherwise variously embodied and practiced within the scope of the following claims.

What is claimed is:

1. A wear-resistant drill pipe collar comprising, a main body having a substantially annular groove and an access opening for said groove defined therein with said groove extending around said main body from opposite locations of said access opening, said main body having an outside surface, said groove being defined by a bottom surface having opposed end edges defining a particular width for said bottom surface and a pair of opposed side surfaces adjoining said end edges, said side surfaces having outer edges spaced apart a distance less than said width to thereby define said groove having a constricted substantially annular opening, a plurality of inserts made of a wear-resistant material disposed within said groove, each of said inserts being confined by said bottom surface and said side surfaces and having an outer portion extending between said constricted opening, each outer portion having a wear-resistant exposed surface which conforms to the configuration of said outside surface, each of said inserts being adapted to be inserted in and removed from said groove through said access opening, and a plug fixed to said main body within said access opening to prevent movement of said inserts within said annular groove and egress of said inserts from said access opening.

2. A collar as set forth in claim 1 in which said access opening has a lowermost surface portion which blends smoothly with said bottom surface to define a substantially right circular cylindrical surface.

3. A collar as set forth in claim 2 wherein said main body has substantially oppositely arranged semicylindrical surfaces adjoining peripheral edge portions of said lowermost surface portion and defining enlarged areas for opposite sides of said access opening.

4. A collar as set forth in claim 3 in which said access opening has an axial length along the longitudinal axis of said collar and a circumferential length each of which is at least equal to said width to enable easy movement of each of said inserts relative to said groove and opening.

5. A collar as set forth in claim 1 in which said main body is made of a particular metal and each of said inserts is made of a metal having a greater wear-resistance than said particular metal.

6. A collar as set forth in claim 1 in which said main body is made of a particular metal and each of said inserts is made of a ceramic material.

7. A collar as set forth in claim 1 in which each of said inserts is comprised of an inner portion and said outer portion, said outer portion being made of a material having a greater wear resistance than the wear resistance of said inner portion.

8. A collar as set forth in claim 7 in which each of said inserts is a single-piece structure wherein said inner portion defines the main body of said insert and is made of steel and said outer portion is integrally fixed to said inner portion.

9. A collar as set forth in claim 8 in which said outer portion of each of said inserts is made of tungsten carbide and is integrally fixed to its inner portion as a welded portion.

10. A collar as set forth in claim 1 in which each of said inserts is made of a material containing between 90 and 99.5 percent by weight of aluminum oxide.

11. A collar as set forth in claim 1 and further comprising means fixing said plug within said access opening.

12. A collar as set forth in claim 1 and further comprising a threaded screw detachably fixing said plug within said access opening.

13. A collar as set forth in claim 1 in which said main body is made of a particular metal, each of said inserts is made of a material having a greater wear resistance than said particular metal, said pair of side surfaces are substantially annular surfaces symmetrically arranged relative to said bottom surface and converging radially outwardly therefrom toward each other, and each of said inserts has a substantially trapezoidal cross-sectional configuration when cut by a diametral plane through said main body.

14. A collar as set forth in claim 13 in which each of said inserts has an inside surface which conforms to a circumferential increment of said bottom surface and said wear-resistant exposed surface conforms to said outside surface.

15. A collar as set forth in claim 14 in which each of said inserts has circumferentially spaced end surfaces which provide a maximum contact area between adjoining surfaces.

16. A wear-resistant drill pipe component comprising, a main body having a plurality of substantially annular grooves and a corresponding plurality of access openings defined therein with each groove extending around said main body from opposite locations of an associated access opening, said main body having an outside surface, each of said grooves being defined by a bottom surface having opposed end edges defining a particular width for the bottom surface and a pair of opposed side surfaces adjoining associated opposed end edges, said side surfaces of each groove having outer edges spaced apart a distance less than said width of its bottom surface to define each groove having a constricted substantially annular opening, a plurality of inserts made of a wear-resistant material disposed within each of said grooves, each of said inserts being confined by an associated bottom surface and side surfaces and having an outer portion extending between an associated constricted opening, each outer portion of each insert having a wear-resistant exposed surface which conforms to the configuration of said outside surface, each of said inserts being adapted to be inserted in and removed from its groove through an associated access opening, and a plurality of plugs each being disposed within an associated access opening and fixed to said main body, each plug preventing movement of associated inserts within an associated annular groove and egress of the associated inserts from an associated access opening.

17. A drill pipe component as set forth in claim 16 in the form of a collar.

18. A drill pipe component as set forth in claim 16 in the form of a coupling collar.

19. A drill pipe component as set forth in claim 16 in combination with a drill pipe, said component and drill pipe being defined as a single-piece structure.

20. A drill pipe component as set forth in claim 19 defined at one end portion of said pipe as a coupling collar.

21. A drill pipe component as set forth in claim 16 in which said main body is a single-piece homogeneous structure and said grooves and access openings are defined therein.

22. A drill pipe component as set forth in claim 21 in which said main body is made of a particular metal and said inserts are made of a material having a wear resistance which is greater than the wear resistance of said particular metal.

23. A method of making a wear-resistant drill pipe collar comprising the steps of, forming a substantially annular groove and an access opening for said groove in the main body of said collar radially inwardly from a cylindrical outside surface thereof and with said groove extending around said main body from opposite locations of said access opening, said groove being defined by a bottom surface having opposed end edges defining a particular width for said bottom surface and a pair of opposed side surfaces adjoining said end edges, said side surfaces having outer edges spaced apart a distance less than said width to thereby define said groove having a constricted substantially annular opening, providing a plurality of inserts made of a wear-resistant material, disposing said inserts within said groove, each of said inserts being confined by said bottom surface and said side surfaces and having an outer portion extending between said constricted opening, each outer portion having a wear-resistant exposed surface which conforms to the configuration of said outside surface, each of said inserts being adapted to be inserted in and removed from said groove through said access opening, and fixing a plug to said main body within said access opening to prevent movement of said inserts within said annular groove and egress of said inserts from said access opening.

24. A method as set forth in claim 23 in which said forming step comprises machining said groove and inlet opening in said main body.

25. A method as set forth in claim 23 in which said providing step comprises providing said inserts made of a ceramic material.

26. A method as set forth in claim 23 in which said providing step comprises providing said inserts made of a metallic material.

27. A method as set forth in claim 23 in which said fixing step comprises detachably fixing said plug to said main body.

* * * * *